United States Patent [19]

Ohmori et al.

[11] Patent Number: 5,069,941

[45] Date of Patent: Dec. 3, 1991

[54] WATER- AND OIL-REPELLENT ANTIFOULING FINISHING AGENT

[75] Inventors: Akira Ohmori, Ibaraki; Hiroshi Inukai, Settsu; Takahiro Kitahara, Suita; Akihiko Ueda, Osaka, all of Japan

[73] Assignee: Daikin Industries, Ltd., Osaka, Japan

[21] Appl. No.: 652,402

[22] Filed: Feb. 7, 1991

Related U.S. Application Data

[62] Division of Ser. No. 324,025, Mar. 16, 1989, abandoned.

[30] Foreign Application Priority Data

Mar. 16, 1988 [JP] Japan ..... 63-63840

[51] Int. Cl.[5] ..... B32B 15/00

[52] U.S. Cl. ..... 427/385.5; 427/393.4

[58] Field of Search ..... 427/385.5, 393.4

[56] References Cited

U.S. PATENT DOCUMENTS

| | | | |
|---|---|---|---|
| 3,329,661 | 7/1967 | Smith et al. | 526/243 |
| 3,356,628 | 12/1967 | Smith et al. | 526/243 |
| 3,654,244 | 4/1972 | Pittman et al. | 526/243 |
| 4,259,407 | 3/1981 | Tada et al. | 526/245 |
| 4,690,869 | 9/1987 | Ohmori et al. | 526/245 |
| 4,720,166 | 1/1988 | Ohmori et al. | 350/96.34 |
| 4,863,236 | 9/1989 | Herbrechtsmeer et al. | 526/245 |
| 4,871,820 | 10/1989 | Ohmori et al. | 526/245 |

FOREIGN PATENT DOCUMENTS

| | | | |
|---|---|---|---|
| 0030115 | 6/1981 | European Pat. Off. | 526/243 |
| 60-258218 | 12/1985 | Japan | 526/245 |

*Primary Examiner*—Joseph L. Schofer
*Assistant Examiner*—N. Sarofim
*Attorney, Agent, or Firm*—Larson and Taylor

[57] ABSTRACT

This invention provides an antifouling finishing agent comprising a fluorine-containing polymer comprising at least 50% by weight of a fluorine-containing acrylate represented by the formula

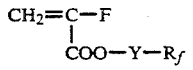

wherein Y is alkylene group having 1 to 3 carbon atoms, a group of the formula $—CH_2CH_2N(R)SO_2—$ (wherein R is alkyl group having 1 to 4 carbon atoms) or a group of the formula $—CH_2CH(OZ)CH_2—$ (wherein Z is hydrogen atom or acetyl group), and $R_f$ is fluoroalkyl group having 3 to 21 carbon atoms or fluoralkyl group having 3 to 21 carbon atoms and containing 1 to 10 oxygen atoms in the carbon chain (provided that no oxygen atom is adjacent or closest to other oxygen atom), said fluoroalkyl groups having at least 5 fluorine atoms.

5 Claims, No Drawings

WATER- AND OIL-REPELLENT ANTIFOULING FINISHING AGENT

This application is a division of application Ser. No. 07/324,025 filed Mar. 16, 1989, is now abandoned.

FIELD OF THE INVENTION

This invention relates to a water-repellent, oil-repellent, fluorine-containing antifouling finishing agent.

BACKGROUND OF THE INVENTION

Known water- and oil-repellent antifouling finishing agents include those containing a urethane compound having long-chain fluoroalkyl group (e.g. Japanese Unexamined Patent Publications Nos.112855/1978; 74000/1979; and 133485/1979).

However, these antifouling finishing agents have the drawback of poor durability because the long-chain fluoroalkyl group-containing urethane compound (hereinafter referred to as "$R_f$ urethane compound") is low in molecular weight.

To improve the durability, $R_f$ urethane compounds having a molecular weight of 800 to 3000 have been proposed (e.g. Japanese Unexamined Patent Publication No.189284/1983).

Yet the antifouling agents containing the proposed $R_f$ urethane compound have disadvantages. Said $R_f$ urethane compounds are difficult to synthesize and the synthesized compounds are mixtures of various structures. Further said $R_f$ urethane compounds have such low fluorine content that the resulting antifouling finishing agents are not fully satisfactory in any of water and oil repellency and antifouling property.

SUMMARY OF THE INVENTION

The main object of the present invention is to provide an antifouling finishing agent which is outstanding not only in water and oil repellency and antifouling property but also in durability.

Other objects and features of the invention will become apparent from the following description.

The present invention provides an antifouling finishing agent comprising a fluorine-containing polymer comprising at least 50% by weight of a fluorine-containing acrylate represented by the formula $$CH_2{=}\underset{\underset{COO-Y-R_f}{|}}{C}-F \qquad (1)$$

wherein Y is alkylene group having 1 to 3 carbon atoms, a group of the formula $-CH_2CH_2N(R)SO_2-$ (wherein R is alkyl group having 1 to 4 carbon atoms) or a group of the formula $-CH_2CH(OZ)CH_2-$ (wherein Z is hydrogen atom or acetyl group), and $R_f$ is fluoroalkyl group having 3 to 21 carbon atoms or fluoroalkyl group having 3 to 21 carbon atoms and containing 1 to 10 oxygen atoms in the carbon chain (provided that no oxygen atom is adjacent or closest to other oxygen atom), said fluoroalkyl groups having at least 5 fluorine atoms.

DETAILED DESCRIPTION OF THE INVENTION

It is essential in this invention to use a fluorine-containing polymer comprising at least about 50% by weight, preferably about 65% by weight or more, of the fluorine-containing acrylate of the formula (1).

The fluoroalkyl groups of the fluorine-containing acrylate of the formula (1) must contain 5 or more fluorine atoms in order to impart improved water and oil repellency and antifouling property to the acrylate.

Preferred examples of the fluorine-containing acrylate of the formula (1) include those represented by the formula $$CH_2{=}\underset{\underset{COO-(CH_2)_m(CF_2)_nCF_3}{|}}{C}-F \qquad (1\text{-a})$$

wherein m is an integer of 1 to 3 and n is an integer of 5 to 13.

Specific examples of the fluorine-containing acrylate of the formula (1) are $CH_2{=}CF-COOCH_2CH_2C_6F_{13}$, $CH_2{=}CF-COOCH_2C_8F_{17}$, $CH_2{=}CF-COOCH_2C_8F_{16}CF(CF_3)_2$, $CH_2{=}CF-COOCH_2-CF(CF_3)OCF_2CF(CF_3)OC_3F_7$, $CH_2{=}CF-COOCH_2-CF(CF_3)OC_3F_7$, $CH_2{=}CF-COOCH_2CH_2-N(CH_3)SO_2C_8F_{17}$, $CH_2{=}CF-COOCH_2CH(OH)CH_2C_9F_{19}$, etc.

The fluorine-containing polymer of the present invention may contain other monomers than the fluorine-containing acrylate of the formula (1). Examples of the other monomers are those represented by the formula $$CH_2{=}\overset{\overset{A}{|}}{\underset{\underset{COO-B}{|}}{C}} \qquad (2)$$

wherein A is hydrogen atom, fluorine atom, chlorine atom or methyl group and B is alkyl group having 1 to 10 carbon atoms, alicyclic group or aromatic group having 6 to 10 carbon atoms, or fluoroalkyl group having 1 to 10 carbon atoms.

Of the monomers of the formula (2), preferred monomers are those capable of producing a homopolymer having a glass transition temperature (hereinafter referred to as "Tg") of 20° C. or higher or those containing alicyclic or aromatic group. The copolymers containing such monomer is capable of giving a tough and hard film sufficient to withstand an impact inflicted on treading by feet.

Preferable of the monomers of the formula (2) are acrylates or methacrylates represented by the formula $$CH_2{=}\overset{\overset{A'}{|}}{\underset{\underset{COO-B'}{|}}{C}} \qquad (2\text{-a})$$

wherein A' is hydrogen atom, fluorine atom or methyl group and B' is methyl group, ethyl group, phenyl group, benzyl group, cyclohexyl group, tert-butyl group, neopentyl group, tricyclodecanyl group, bornyl group, isobornyl group, dicyclopentenyl group or phenoxyethyl group.

Specific examples of the monomer of the formula (2) are $CH_2{=}CHCOO-R^1$ (wherein $R^1$ is cyclohexyl group), $CH_2{=}C(CH_3)COOCH_3$, $CH_2{=}C(CH_3)COOC_{18}H_{37}$, $CH_2{=}C(CH_3)COOCH_2CH_2C_7F_{15}$, $CH_2{=}C(Cl)COOCH_3$,

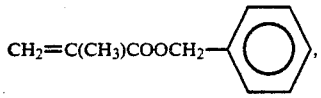

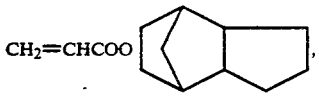

$CH_2{=}CF{-}COOCH_3$, $CH_2{=}CF{-}COOR^1$ (wherein $R^1$ is as defined above), etc.

Other monomers than the monomer of the formula (26) (hereinafter referred to as "monomer (3)") can be incorporated in the fluorine-containing polymer. Examples of the monomer (3) are ethylenically unsaturated monomers including ethylene, propylene, styrene, vinyl chloride, vinylidene chloride, acrylates or methacrylates having functional group such as vinyl group, hydroxyl group, carboxyl group, glycidyl group, dialkylamino group, trialkoxysilyl group or the like.

Preferable of such monomers (3) are acrylates or methacrylates having functional group.

Specific examples of the acrylates or methacrylates having functional group are $CH_2{=}CHCOOCH_2CH_2OH$, $CH_2{=}CHCOO{-}R^2$ ($R^2$ is glycidyl group), $CH_2{=}C(CH_3)COOCH_2CH_2CH_2Si(OCH_3)_3$, $CH_2{=}CHCOOH$, $CH_2{=}C(CH_3)COOH$, $CH_2{=}C(CH_3)COONHCH_2OH$, etc.

Inexpensive monomers such as ethylene, propylene, styrene, vinyl chloride, vinylidene chloride or the like serve to decrease the cost for production of the fluorine-containing polymer and give hardness and other properties to the film formed from the fluorine-containing polymer.

The amount of the monomer of the formula (2) and/or the monomer (3) in the polymer to be used in the invention is about 50% by weight or less. The polymer comprises preferably about 65 to about 90% by weight of the monomer of the formula (1), about 10 to about 35% by weight of the monomer of the formula (2) and 0 to about 10% by weight of the monomer (3).

The fluorine-containing polymer containing functional group can provide a film of antifouling finishing agent with an improved adhesion to an article to be treated. Further, it is possible to crosslink the fluorine-containing polymer by utilizing the functional group. The crosslinking can be accomplished by conventional methods commonly employed in the art (e.g. Japanese Examined Patent Publication No.42880/1972). The acrylate or methacrylate having such functional group useful as a source of functional group of fluorine-containing polymer is used usually in an amount of 10% by weight or less. Optionally the polymer to be used in the invention may be blended with an $R_f$ urethane compound, and also with methyl methacrylate or the like insofar as the blending does not adversely affect the properties of the polymer.

The copolymer to be used in the invention may be blended with polymethyl methacrylate, polyisobutyl methacrylate or a copolymer comprising these monomers and other monomer insofar as the blending does not adversely affect the properties of the copolymer. The blending lowers the cost, hence economical. Preferred polymers useful for the blending are those having a glass transition temperature (Tg) of 50° C. or higher. Examples of such polymers are Elvacites 2041, 2042, 2013, 2045 and Ep 2021 and the like (trade names for products of Du Pont).

It is desirable that the fluorine-containing polymer to be used in the invention have a number-average molecular weight of about 10000 to about 4000000 as determined by gel permeation chromatography, and an inherent viscosity ($\eta$) of about 0.25 to about 3.0 as determined at 35° C. using a solvent such as m-xylene hexafluoride, methyl ethyl ketone, chloroform, 1,1,1-trichloroethane or the like. If the polymer used has a number-average molecular weight of less than about 10000, the film formed from the finishing agent tends to easily separate from the article, and is poor in antifouling property. On the other hand, if the polymer used has a number-average molecular weight of more than about 4000000, the finishing agent of the invention is difficult to apply to the article to be treated.

Moreover, it is preferred to use a fluorine-containing polymer having Tg or a melting point (hereinafter referred to as "Tm") of about 35° C. or higher in view of the durability particularly against treading by shod feet.

The fluorine-containing polymer to be used in the invention can be prepared by radical polymerizations such as solution polymerization, bulk or mass polymerization or emulsion polymerization.

Examples of solvents useful in solution polymerization are m-xylene hexafluoride, trichlorotrifluoroethane and like fluorine-type solvents, 1,1,1-trichloroethane and like chlorine-type solvents, etc. In use, the polymer prepared by solution polymerization is made into a solution after drying following the separation from the solvent. Optionally the polymer solution may be merely diluted after completion of polymerization.

Examples of polymerization initiators useful in solution and bulk (or mass) polymerizations are azobisisobutyronitrile and like azo compounds, benzoyl peroxide and like peroxide compounds, etc.

Examples of chain transfer agents useful in solution and bulk (or mass) polymerizations are lauryl mercaptan, thiophenol and like mercaptans, etc.

A preferred polymerization temperature is about 30° to about 100° C. in any of said polymerization methods.

The fluorine-containing polymer thus prepared by solution or bulk (or mass) polymerization is usually dissolved in a solvent capable of dissolving well said polymer and then is diluted with a solvent having a dissolving power sufficient to dissolve the polymer without precipitation. Subsequently the diluted solution is applied to an article to be treated. The application can be done by methods commonly employed for known antifouling finishing agents, such as dipping, brushing or spraying methods. A preferred concentration of the diluted solution is in the range of about 0.1 to about 30% by weight in brushing application and about 0.05 to about 15% by weight in spraying application. After application, the coated article is dried at a temperature ranging from room temperature to about 150° C.

Examples of solvents useful for dissolution are m-xylene hexafluoride, trichlorotrifluoroethane and like fluorine-type solvents, trichloroethane and like chlorine-type solvents, etc. Examples of solvents useful for dilution are tetrachloroethylene, trichloroethylene and like chlorine-type solvents, acetone and like ketones, ethyl acetate and like esters, toluene and like aromatic solvents, n-pentane and like saturated aliphatic solvents, ethanol, isopropanol and like alcohols, etc. The solvents useful for dissolution can be used also for dilution.

Examples of emulsifying agents useful in emulsion polymerization are nonionic, cationic and anionic compounds among which nonionic compounds are preferable.

Preferred polymerization initiators useful in emulsion polymerization include water-soluble compounds such as azobisisobutyroamidine hydrochloride and like azo compounds, succinic acid peroxide and like peroxide compounds, etc.

A preferred emulsion polymerization temperature is about 30° to about 100° C.

The fluorine-containing polymer prepared by emulsion polymerization can be used as an aqueous type antifouling finishing agent. Generally the emulsifier need not be removed from the polymer. The aqueous type antifouling finishing agent can be applied by the same methods as described above. The aqueous type antifouling finishing agent, which contains water, is preferably heated to about 100° to about 150° C. for drying.

The antifouling finishing agent of the invention is usable for applications requiring resistance to wear, more specifically in treating solid substrates such as tents, sheet covers, carpets, sofas, curtains or the like to impart an antifouling property.

The antifouling finishing agent of the invention may be mixed with a synthetic resin to provide the resin with an antifouling property. For this purpose, the anti-fouling finishing agent is used in an amount of about 0.05 to about 20 parts by weight, preferably about 0.1 to about 2 parts by weight, per 100 parts by weight of the resin.

The synthetic resins usable for this application are not specifically limited and include a wide range of known resins. Examples of such resins are polyvinyl chloride, polystyrene, polyamide, polyester, polyacetal, polycarbonate, polyacryl, vinyl chloride-vinyl acetate copolymer, vinylidene chloride-vinyl chloride copolymer, epoxy resin, unsaturated polyester resins, phenol resins, urea resins, etc. Different resins can be used in mixture and filler-containing resins are usable.

The antifouling finishing agent of the invention can be mixed with a synthetic resin by methods not specifically limitative which include wet blending, dry blending and like methods. Of the methods, a suitable method is employed according to the kind of synthetic resins.

The antifouling finishing agent of the invention is superior to conventional ones in the ability to provide a film with excellent strength and high adhesion to articles to be treated and is outstanding also in durability.

EXAMPLES

The present invention will be described below in greater detail with reference to the following Examples, Comparison Examples, Test Examples and Comparison Test Examples.

EXAMPLE 1

A 200 cc glass ampoule was charged with 75 g of a monomer of the formula $CH_2{=}CF{-}COOCH_2CH_2C_8F_{17}$ (hereinafter referred as "αF17F"), 22 g of tricyclodecanyl acrylate (hereinafter referred to as "TCDA"), 3 g of glycidyl methacrylate (hereinafter referred to as "GMA"), 200 g of m-xylene hexafluoride (hereinafter referred to as "m-XHF") and 1.5 g of azobisisobutyronitrile. A deaeration and nitrogen-purge procedure was repeated thrice by a freezing-thawing method using methanol/dry ice. Thereafter the ampoule was closed by heat-sealing.

The ampoule was immersed for 24 hours in a temperature-controlled bath maintained at 50° C.

Subsequently a 30 g portion of 300 g of reaction mixture was added to methanol after which the precipitated fluorine-containing polymer was dried to give 9.9 g of fluorine-containing polymer.

The inherent viscosity ($\eta$) of the polymer was determined at 35° C. using m-XHF as a solvent and was found to be 0.68. Elementary analysis shows that the polymer contains 40.2% carbon, 47.9% fluorine and 2.9% hydrogen.

The remaining portion of the reaction mixture was diluted with a trichlorotrifluoroethane/1,1,1-trichloroethane solvent mixture (ratio by weight of 1:1) to a polymer concentration of 1% by weight, giving a solution of antifouling finishing agent.

EXAMPLES 2 to 6

A solution of antifouling finishing agent was prepared in the same manner as done in Example 1 using the monomers as shown in Table 1. In this way, 5 kinds of solutions of antifouling finishing agents were prepared.

EXAMPLE 7

The polymer prepared in Example 5 was dissolved in 1,1,1-trichloroethane to give a solution having a concentration of 5% by weight (hereinafter referred to as "solution A"). PMMA ("Elvacite 2041," product of Du Pont) was dissolved in 1,1,1-trichloroethane to give a solution having a concentration of 5% by weight (hereinafter referred to as "solution B"). A mixture of solutions A and B (ratio by weight of 2:1) was diluted with 1,1,1-trichloroethane to a concentration of 1% by weight, producing a solution of antifouling finishing agent.

EXAMPLE 8

A solution of antifouling finishing agent was prepared in the same manner as done in Example 7 with the exception of using a mixture of solutions A and B (ratio by weight of 1:1).

COMPARISON EXAMPLE 1

A solution of antifouling finishing agent was prepared by repeating the same procedure as in Example 1 with the exception of using 75 g of monomer of the formula $CH_2{=}CH{-}COOCH_2CH_2C_8F_{17}$, 20 g of cyclohexyl acrylate (hereinafter referred to as "CHA") and 5 g of GMA.

COMPARISON EXAMPLE 2

A 4-necked 100 ml flask equipped with a stirrer, a thermometer, a reflux condenser and a dropping funnel was charged with 10.2 g of toluidine diisocyanate (product of Hitachi Kasei Kabushiki Kaisha, tradename "Coronate T65") and 26.6 g of a monomer of the formula $C_8F_{17}CH_2CH_2OH$. The mixture was reacted at 70° C. for 8 hours. Methanol (1.9 g) was added to the reaction mixture to achieve 8 hours of reaction, giving an $R_f$-containing urethane compound of the formula

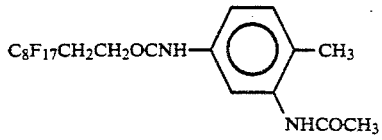

The thus obtained $R_f$urethane compound was diluted with 1,1,1-trichloroethane to a concentration of 1% by weight, giving a solution of antifouling finishing agent.

COMPARISON EXAMPLE 3

A solution of antifouling finishing agent was prepared in the same manner as done in Example 1 with the exception of using 25 g of a monomer of the formula $CH_2{=}CF{-}COOCH_2CH_2C_9F_{19}$ (hereinafter referred to as "$\alpha F_{19}F$"), 58 g of ethylene glycol methacrylate and 15 g of stearyl methacrylate.

TEST EXAMPLES 1 TO 8 AND COMPARISON TEST EXAMPLE 3

A nylon taffeta piece was dipped in the solution of antifouling finishing agent prepared in one of Examples 1 to 8 and Comparison Test Example 3. The treated fabric was air-dried for 24 hours to produce a test specimen. In this way, 9 kinds of test specimens were prepared in the same manner as above by dipping nylon taffeta pieces in the solutions obtained in said examples.

The test specimens were tested for properties by the following methods.

Water Repellency

Several drops of an aqueous solution of isopropanol were deposited on the surface of the test specimen. The result was observed in 30 seconds to inspect whether the drops had penetrated the test specimen. The water repellency of the test specimen was evaluated according to the following ratings (point) on the basis of the concentration at which the drops were retained over the surface without penetration.

| Point | Concentration of aqueous solution of isopropanol (% by volume) |
|---|---|
| 11 | 100 |
| 10 | 90 |
| 9 | 80 |
| 8 | 70 |
| 7 | 60 |
| 6 | 50 |
| 5 | 40 |
| 4 | 30 |
| 3 | 20 |
| 2 | 10 |
| 1 | 0 |
| 0 | No drop retained |

Oil Repellency

Several drops of a liquid (as shown in a table below) were deposited on the surface of the test specimen. The result was observed in 30 seconds to inspect whether the drops had penetrated the test specimen. The oil repellency of the test specimen was evaluated according to the following ratings (point) on the basis of the kind of liquid whose drops were retained over the surface without penetration.

| Point | Liquid |
|---|---|
| 8 | n-Heptane |
| 7 | n-Octane |
| 6 | n-Decane |
| 5 | n-Dodecane |
| 4 | n-Tetradecane |
| 3 | n-Hexadecane |
| 2 | n-Hexadecane/Nujol* (35:65 mixture) |

-continued

| Point | Liquid |
|---|---|
| 1 | Nujol |
| 0 | Drops of Nujol not retained |

Note: "Nujol" is a tradename for petrolatum.

Antifouling Property

The test specimen was cut to a square shape (7 cm×7 cm). The square specimen was placed into a polyethylene bag together with an artificial dry soil (as shown below in a table) in an amount of twice the weight of the specimen. The bag containing the specimen was vigorously shaken for 2 minutes to soil the specimen Then the artificial dry soil was taken off by a vacuum cleaner. A reflectance (whiteness degree) was measured with a digital reflectance meter. A percent degree of stain was given by the following equation:

$$\text{Percent degree of stain (\%)} = \frac{A - B}{A} \times 100$$

wherein A is a reflectance of unstained specimen and B is a reflectance of stained specimen.

| Artificial Dry Soil | |
|---|---|
| Peat moss | 38 (% by weight) |
| Cement | 17 |
| Kaolin | 17 |
| Silica | 17 |
| Carbon | 1.75 |
| Ferric oxide | 0.50 |
| Liquid paraffin | 8.75 |

Stain By Treading

The test specimen was cut to a square shape (30 cm×30 cm). The square fabric was attached to the surface of a corridor in a building and trodden by shod feet for 24 hours. The fabric was cleaned by a vacuum cleaner after which the reflectance (whiteness degree) was measured by a digital reflectance meter. A percent degree of stain by treading was given by the following equation:

$$\text{Percent degree of stain by treading (\%)} = \frac{A - B}{A} \times 100$$

wherein A is a reflectance of specimen before treading and B is a reflectance of specimen after treading After treading, the water repellency and oil repellency of the specimens were also determined.

COMPARISON TEST EXAMPLES 1 and 2

A nylon taffeta piece was dipped in the solution of antifouling finishing agent prepared in Comparison Test Example 1. The treated fabric was heated at 130° C for 30 minutes and air-dried for 24 hours to produce a test specimen. Another test specimen was produced by repeating the same procedure with the exception of using the solution prepared in Comparison Test Example 2. The two test specimens were checked for the same properties as in Test Examples. Table 1 below shows the results.

The following abbreviations were used in Table 1 to designate the monomers.

$\alpha F17F$ for $CH_2{=}CFCOOCH_2CH_2C_8F_{17}$

TCDA for $CH_2{=}CHCOO$

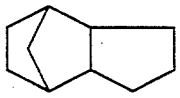

GMS for $CH_2{=}CHCOOCH_2CHCH_2$

CHA for $CH_2{=}CHCOO$

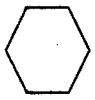

SiMA for $CH_2{=}C(CH_3)COO(CH_2)_3Si(OCH_3)_3$
αF19F for $CH_2{=}CFCOOCH_2CH_2(CF_2CF_2)_3CF(CF_3)_2$
MMA for $CH_2{=}C(CH_3)COOCH_3$ BzMA for $CH_2{=}C(CH_3)COOCH_2$

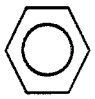

HEA for $CH_2{=}CHCOOCH_2CH_2OH$
17FA for $CH_2{=}CHCOOCH_2CH_2C_8F_{17}$
EGMA for $CH_2{=}C(CH_3)COO(CH_2CH_2O)_3OCC(CH_3){=}CH_2$
MA for $CH_2{=}CHCOOCH_3$
SMA for $CH_2{=}C(CH_3)COOC_{18}H_{37}$ The mixture was kneaded by a roll to form a film of 150 μm thickness.

A test specimen was produced by the following method. The film was cut to strips each measuring 5 cm by 10 cm. Ten strips were superposed over one another and pressed into a sheet under a load of 1 kg. The sheet was left to stand at 45° C. and at 85% RH for one month, giving a test specimen.

Thereafter the test specimen was dipped in an artificial sewage water consisting of 94% black soil, 4% water and 2% liquid paraffin, withdrawn and lightly shaken to let fall part of soil held thereto. The specimen was weighed and found to have 0.03 mg/m$^2$ of soil held thereto. The same procedure as above was conducted using a film free of the antifouling finishing agent of the invention. It was found that the film had 0.25 mg/m$^2$ of soil held thereto.

We claim:

1. A method of providing an article surface with anti-fouling properties which comprises applying to said surface a solution of an anti-fouling finishing agent comprising at least 50% by weight of a fluorine-containing acrylate represented by the formula $$CH_2{=}\underset{\underset{COO-Y-R_f}{|}}{C}-F$$

wherein Y is alkylene group having 1 to 3 carbon atoms, a group of the formula $-CH_2CH_2N(R)SO_2-$ (wherein R is alkyl group having 1 to 4 carbon atoms) or a group

TABLE 1

| | Composition of monomers of copolymer for antifouling finishing agent (Ratio by wt %) | [η] | Before Shod-foot Treading: Water-repellency (point) | Before Shod-foot Treading: Oil-repellency (point) | Percent degree of stain by dry soil (%) | After Shod-foot Treading: Water-repellency (point) | After Shod-foot Treading: Oil-repellency (point) | Percent degree of stain by shod-foot treading (%) |
|---|---|---|---|---|---|---|---|---|
| Test Ex. 1 | αF17F/TCDA/GMA 75/22/3 | 0.68 | 11 | 8 | 0.78 | 8 | 3 | 4.60 |
| Test Ex. 2 | αF17F/CHA/GMA 78/20/2 | 0.70 | 11 | 8 | 3.06 | 6 | 2 | 7.72 |
| Test Ex. 3 | αF17F/TCDA/SiMA 75/23/2 | 0.42 | 11 | 8 | 3.15 | 7 | 3 | 6.44 |
| Test Ex. 4 | αF19F/MMA 75/25 | 0.68 | 10 | 7 | 3.80 | 8 | 3 | 10.21 |
| Test Ex. 5 | αF17F/TCDA/GMA 66/30/4 | 1.11 | 9 | 7 | 3.25 | 7 | 2 | 7.35 |
| Test Ex. 6 | αF19F/BzMA/HEA 67/30/3 | 0.42 | 9 | 6 | 4.25 | 5 | 2 | 10.25 |
| Test Ex. 7 | αF17F/TCDA/GMA 66/30/4 | 1.11 | 9 | 7 | 4.12 | 8 | 7 | 10.11 |
| Test Ex. 8 | αF17F/TCDA/GMA 66/30/4 | 1.11 | 8 | 6 | 4.23 | 8 | 5 | 10.52 |
| Comparison Test Ex. 1 | 17FA/CHA/GMA 75/20/5 | 0.22 | 11 | 8 | 6.12 | 0 | 0 | 23.08 |
| Comparison Test Ex. 2 | $C_8F_{17}CH_2CH_2OCNH-C_6H_3(CH_3)-NHCOCH_3$ | — | 6 | 6 | 1.25 | 2 | 0 | 8.22 |
| Comparison Test EX. 3 | αF19F/EGMA/MA/SMA 25/2/58/15 | 0.35 | 3 | 1 | 18.21 | 0 | 0 | 30.02 |

EXAMPLE 9

One part by weight of the solution of antifouling finishing agent prepared in Example 1 was added to 100 parts by weight of a commercial vinyl chloride resin.

of the formula $-CH_2CH(OZ)CH_2-$ (wherein Z is hydrogen atom or acetyl group), and $R_f$ is fluoroalkyl group having 3 to 21 carbon atoms and containing 1 to 10 oxygen atoms in the carbon chain (provided that no oxygen atom is adjacent or closest to other oxygen atom), said fluoroalkyl groups having at least 5 fluorine atoms and drying the applied solution.

2. A method according to claim 1 wherein the fluorine-containing polymer is a copolymer comprising:

(a) about 65 to about 90% by weight of a fluorine-containing acrylate represented by the formula

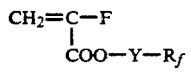

wherein Y is alkylene group having 1 to 3 carbon atoms, a group of the formula $—CH_2CH_2N(R-)SO_2—$ (wherein R is alkyl group having 1 to 4 carbon atoms) or a group of the formula $—CH_2CH(OZ)CH_2—$ (wherein Z is hydrogen atom or acetyl group), and $R_f$ is fluoroalkyl group having 3 to 21 carbon atoms or fluoroalkyl group having 3 to 21 carbon atoms and containing 1 to 10 oxygen atoms in the carbon chain (provided that no oxygen atom is adjacent to other oxygen atom), said fluoroalkyl groups having at least 5 fluorine atoms;

(b) about 10 to about 35% by weight of an acrylate or methacrylate represented by the formula

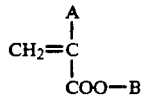

wherein A is hydrogen atom, fluorine atom, chlorine atom or methyl group and B is alkyl group having 1 to 10 carbon atoms, alicyclic group or aromatic group having 6 to 10 carbon atoms, or fluoroalkyl group having 1 to 10 carbon atoms; and (c) 0 to about 10% by weight of an ethylenically unsaturated monomer.

3. A method according to claim 1 wherein:

(i) the fluorine-containing acrylate (a) is a compound represented by the formula

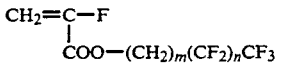

wherein m is an integer of 1 to 3 and n is an integer of 5 to 13;

(ii) the acrylate or methacrylate (b) is a compound represented by the formula

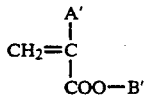

wherein A' is hydrogen atom, fluorine atom or methyl group and B' is methyl group, ethyl group, phenyl group, benzyl group, cyclohexyl group, tert-butyl group, neopentyl group, tricyclodecanyl group, bornyl group, isobornyl group, dicyclopentenyl group or phenoxyethyl group; and (iii) the ethylenically unsaturated monomer (c) is an acrylate or methacrylate having functional group.

4. A method according to claim 1 wherein the fluorine-containing polymer has a glass transition temperature or a melting point of 35° C. or higher.

5. A method according to claim 1 wherein the fluorine-containing polymer has a number-average molecular weight of about 10000 to about 4000000 as determined by gel permeation chromatography.

* * * * *